US008215710B2

(12) United States Patent
Erker

(10) Patent No.: US 8,215,710 B2
(45) Date of Patent: Jul. 10, 2012

(54) SEAT HAVING A SEAT PANEL AND A BACKREST

(75) Inventor: Christian Erker, Erbendorf (DE)

(73) Assignee: Sato Office GmbH (DE)

( * ) Notice: Subject to any disclaimer, the term of this patent is extended or adjusted under 35 U.S.C. 154(b) by 281 days.

(21) Appl. No.: 12/517,401

(22) PCT Filed: Nov. 29, 2007

(86) PCT No.: PCT/EP2007/010352

§ 371 (c)(1),
(2), (4) Date: Sep. 14, 2009

(87) PCT Pub. No.: WO2008/067947

PCT Pub. Date: Jun. 12, 2008

(65) Prior Publication Data

US 2010/0084904 A1 Apr. 8, 2010

(30) Foreign Application Priority Data

Dec. 4, 2006 (DE) ..... 10 2006 056 928

(51) Int. Cl.
*A47C 3/00* (2006.01)

(52) U.S. Cl. ..... 297/300.2; 297/322; 297/316

(58) Field of Classification Search ..... 297/300.2, 297/300.4, 300.5, 316, 321, 322
See application file for complete search history.

(56) References Cited

U.S. PATENT DOCUMENTS 2,321,385 A * 6/1943 Herold ..... 297/300.5
3,941,417 A * 3/1976 Re ..... 297/85 R
4,411,469 A 10/1983 Drabert et al.
4,456,297 A * 6/1984 Pietschmann et al. ..... 297/316
4,629,249 A * 12/1986 Yamaguchi ..... 297/300.3
4,640,548 A * 2/1987 Desanta ..... 297/300.3
4,681,369 A * 7/1987 Simpson ..... 297/316
4,685,733 A * 8/1987 Machate et al. ..... 297/284.4

(Continued)

FOREIGN PATENT DOCUMENTS

DE 3027311 2/1981

(Continued)

OTHER PUBLICATIONS

International Search Report, PCT/EP2007/010352, dated Mar. 26, 2008.

*Primary Examiner* — David Dunn
*Assistant Examiner* — David E Allred
(74) *Attorney, Agent, or Firm* — Lerner, David, Littenberg, Krumholz & Mentlik, LLP

(57) ABSTRACT

A seat (10) having a seat panel (12) and a backrest (14) is described. The seat panel (12) is connected to a base device (16) by means of a first connecting device (18). The backrest (14) is connected to the seat panel (12) by means of a second correcting device (20). The first connecting device (18) comprises a pair of front and a pair of rear connecting levers (22, 24). The front connecting levers (22) are longer than the rear connecting levers (24). The rear connecting levers (24) are designed with an angled extension (34) so as to form toggle levers. The second connecting device (20) comprises a pair of rod elements (36) which are mounted in a pivotable and linearly movable manner on the seat panel (12) by way of their front end (38) and which are connected in a pivotable manner to the angled extension (34) of the rear connecting levers (24).

12 Claims, 9 Drawing Sheets

U.S. PATENT DOCUMENTS

Figure 1:
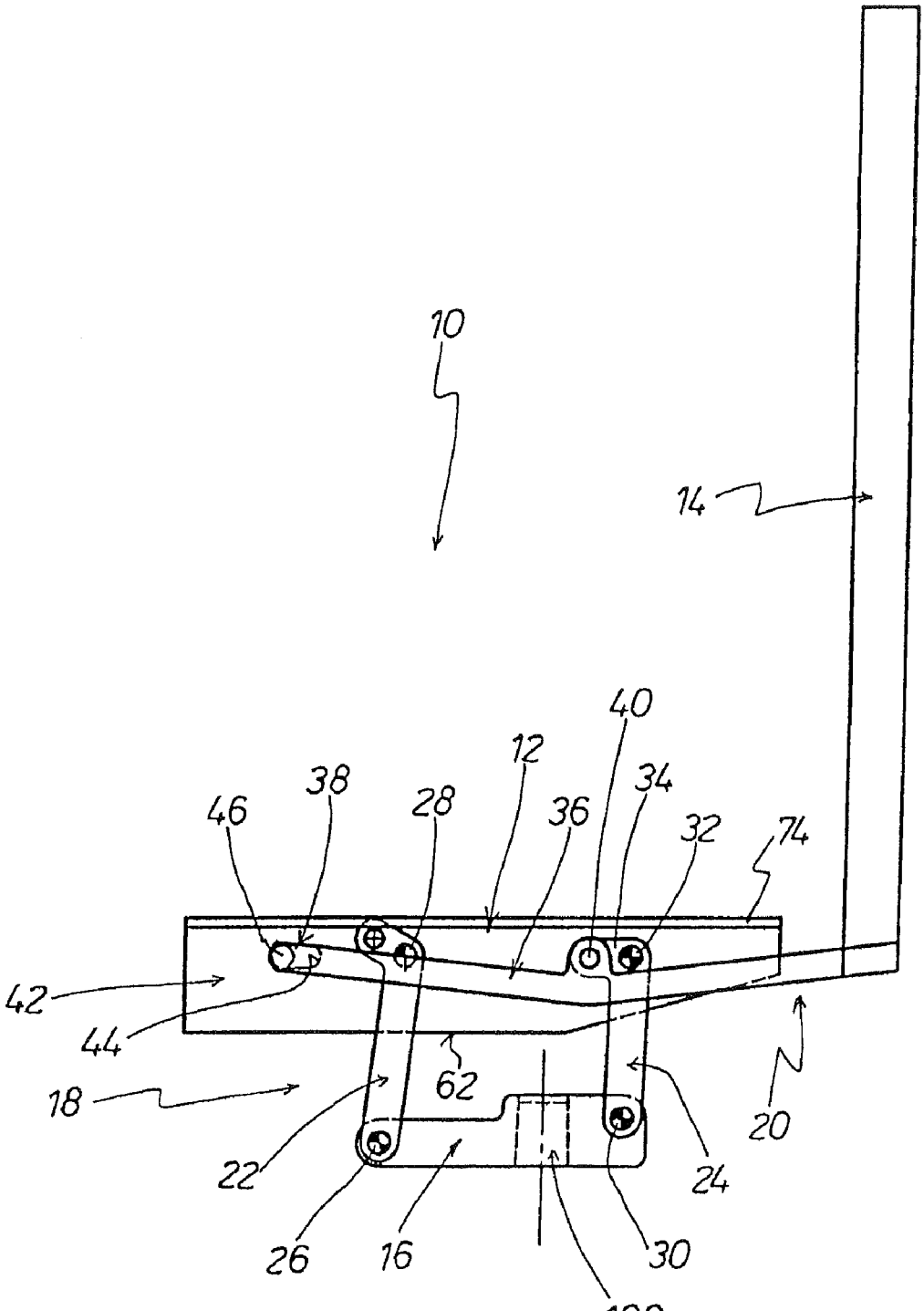

| | | | | |
|---|---|---|---|---|
| 4,740,031 | A * | 4/1988 | Rogers, Jr. | 297/85 L |
| 4,761,033 | A | 8/1988 | Lanuzzi et al. | |
| 4,789,203 | A * | 12/1988 | van Zee et al. | 297/300.1 |
| 4,966,411 | A * | 10/1990 | Katagiri et al. | 297/300.7 |
| 5,261,727 | A * | 11/1993 | Klaebel | 297/423.13 |
| 5,683,139 | A * | 11/1997 | Golynsky et al. | 297/302.3 |
| 5,782,536 | A * | 7/1998 | Heidmann et al. | 297/440.15 |
| 5,979,985 | A * | 11/1999 | Bauer et al. | 297/340 |
| 6,139,103 | A * | 10/2000 | Hybarger et al. | 297/300.5 |
| 6,511,128 | B2 * | 1/2003 | Piretti | 297/300.4 |
| 6,582,019 | B2 * | 6/2003 | Insalaco et al. | 297/300.4 |
| 6,709,058 | B1 * | 3/2004 | Diffrient | 297/320 |
| 6,932,430 | B2 * | 8/2005 | Bedford et al. | 297/300.2 |
| 7,401,858 | B2 * | 7/2008 | Lee | 297/383 |
| 2001/0000939 | A1 * | 5/2001 | Roslund et al. | 297/303.3 |
| 2002/0041118 | A1 * | 4/2002 | Howell | 297/300.2 |
| 2003/0052520 | A1 * | 3/2003 | Erne | 297/300.2 |
| 2004/0026973 | A1 * | 2/2004 | Sander et al. | 297/316 |
| 2004/0245839 | A1 * | 12/2004 | Bodnar et al. | 297/452.63 |
| 2007/0222265 | A1 * | 9/2007 | Machael et al. | 297/300.2 |
| 2009/0015047 | A1 * | 1/2009 | Baumann | 297/300.2 |

FOREIGN PATENT DOCUMENTS

| | | |
|---|---|---|
| EP | 0247311 | 12/1987 |
| EP | 0339089 | 11/1989 |

* cited by examiner

SEAT HAVING A SEAT PANEL AND A BACKREST

CROSS-REFERENCE TO RELATED APPLICATIONS

The present application is a national phase entry under 35U.S.C. §371 of International Application No. PCT/EP2007/010352 filed Nov. 29, 2007, published in German, which claims priority from German Application No. 10 2006 056 928.8 filed on Dec. 4, 2006, all of which are incorporated herein by reference.

The invention relates to a seat having a seat panel and a backrest, wherein the seat panel is connected to a base device by way of a first connecting device and can be adjusted with respect to the base device in height and at the same time in inclination and in the seat longitudinal direction, and wherein the backrest is connected to the seat panel by means of a second connecting device and can be simultaneously adjusted with the seat panel in inclination and in height.

The object on which the invention is based is to provide a seat such as this that combines a structurally simple design with optimum seating comfort.

This object is achieved according to the invention in the case of a seat of the aforementioned type in that the first connecting device comprises, laterally opposite one another, a pair of front and a pair of rear connecting levers, wherein the front connecting levers are longer than the rear connecting levers, in that the rear connecting levers are each designed with an angled extension so as to form toggle levers, and in that the second connecting device comprises, laterally opposite one another, a pair of rod elements which are mounted in a pivotable and linearly movable manner on the seat panel by way of their front end and which are connected in a pivotable manner to the angled extension of the rear connecting levers.

The two front connecting levers situated laterally opposite one another and the two rear connecting levers situated laterally opposite one another effectively form a parallelogram linkage between the base device and the seat panel, with the dimensioning of the front and the rear connecting levers ensuring that, during a pivoting movement of the connecting levers, the seat panel is adjusted, with respect to the base device, and as seen in the seat longitudinal direction, from an at lease approximately horizontal position into a forward and upward position and with its rear part into a downward position. At the same time, the backrest is adjusted into a forward position by way of its lower part and into a rearward position by way of its shoulder portion. This results in good seating comfort while at the same time preventing the so-called "shirt-pullout effect".

In the seat according to the invention, the seat panel may be designed with slots, and a guide element which is guided in the associated slot may be provided at the front end of the respective rod element. It is possible in this way for the front ends of the two rod elements situated laterally opposite one another to be mounted on the seat panel in a pivotable and linearly movable manner.

In another possibility, guide sleeves which are designed with a blind hole and into which the front end of the respective rod element extends in a linearly movable manner are provided in a pivotable manner on the seat panel. These guide sleeves are designed, for example, as sliding shoes.

In yet another possibility of providing the front end of the rod elements with the ability to move in a pivotable and at the same time linear manner with respect to the seat panel, guide members through which the front end of the rod elements extends in a linearly movable manner are provided in a pivotable manner on the seat panel. These pivotable guide members may be designed as trunnions, balls or the like with a through hole for the associated rod element.

It has proven to be expedient in the seat according to the invention if the two front connecting levers are each designed with an angled extension at their end portion assigned to the seat panel, with the two extensions being connected to one another by means of a connecting rod. This connecting rod is advantageously provided for a weight-adjustment device. This weight-adjustment device may comprise an elastically compliant wedge element which can be adjusted with respect to the connecting rod. In another possibility, the weight-adjustment device comprises a dimensionally stable wedge element, which is fastened to the connecting rod, and a body made of an elastically compliant material which can be adjusted with respect to the Wedge element.

It has proven to be expedient in the seat according to the invention if the seat panel has a trough-like design with two longitudinal side walls and longitudinal edges projecting laterally away therefrom on the upper side in opposite directions from one another. This results in a desired degree of dimensional stability, with it being possible at the same time for the aforementioned weight-adjustment device to be accommodated without problem.

In one design of the last-mentioned type, the longitudinal edges or the longitudinal side walls may be designed with cutouts for the connecting rod which connects the front connecting levers.

According to the invention, the base device may be provided on a chair column element. This column element may be adjustable in its length in order to achieve a height-adjustable chair. This chair is expediently an office chair.

The chair column element may comprise a damping device. This damping device is, for example, a gas spring as used in office chairs.

Figure 2:
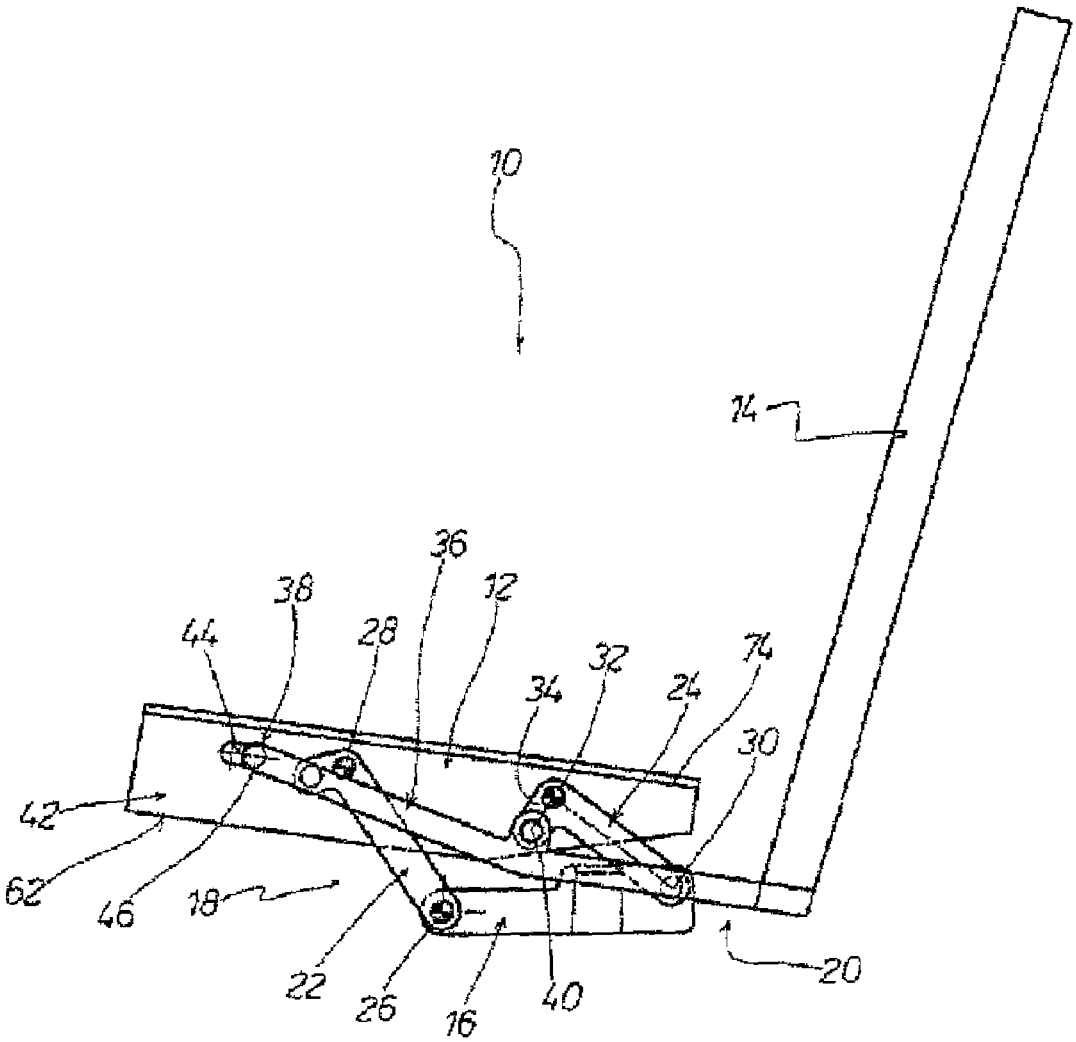
Figure 3:
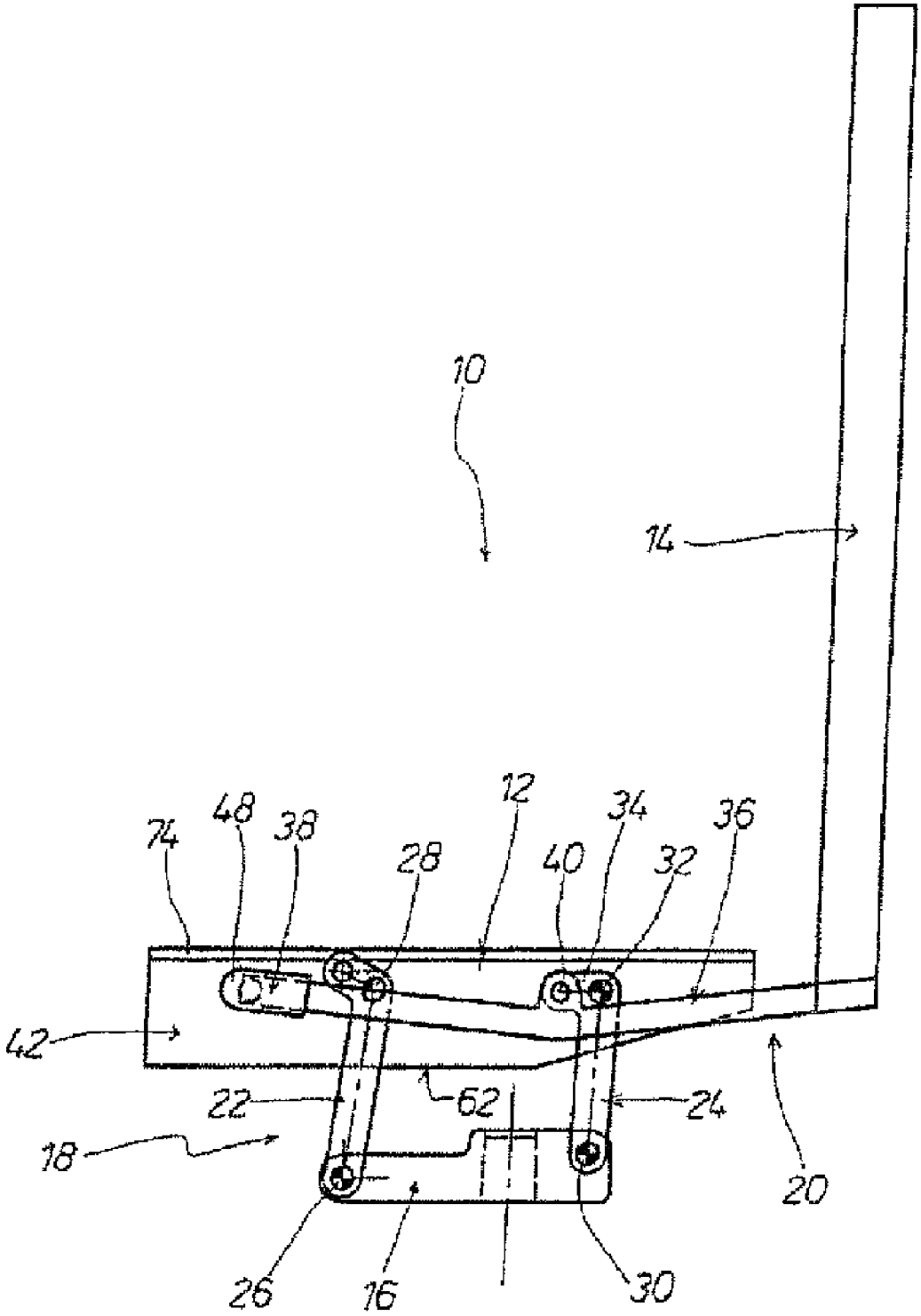
Figure 4:
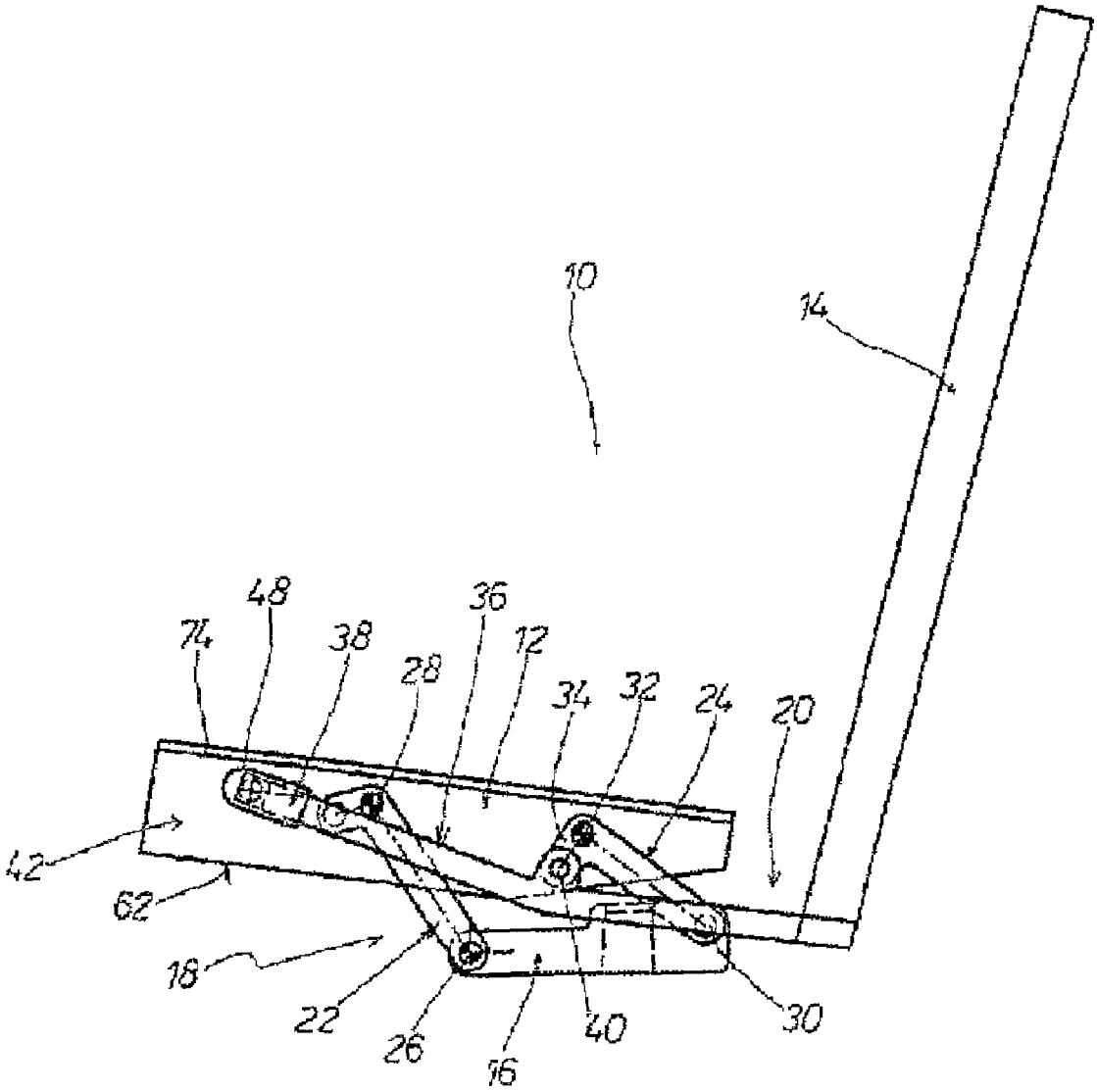
Figure 5:
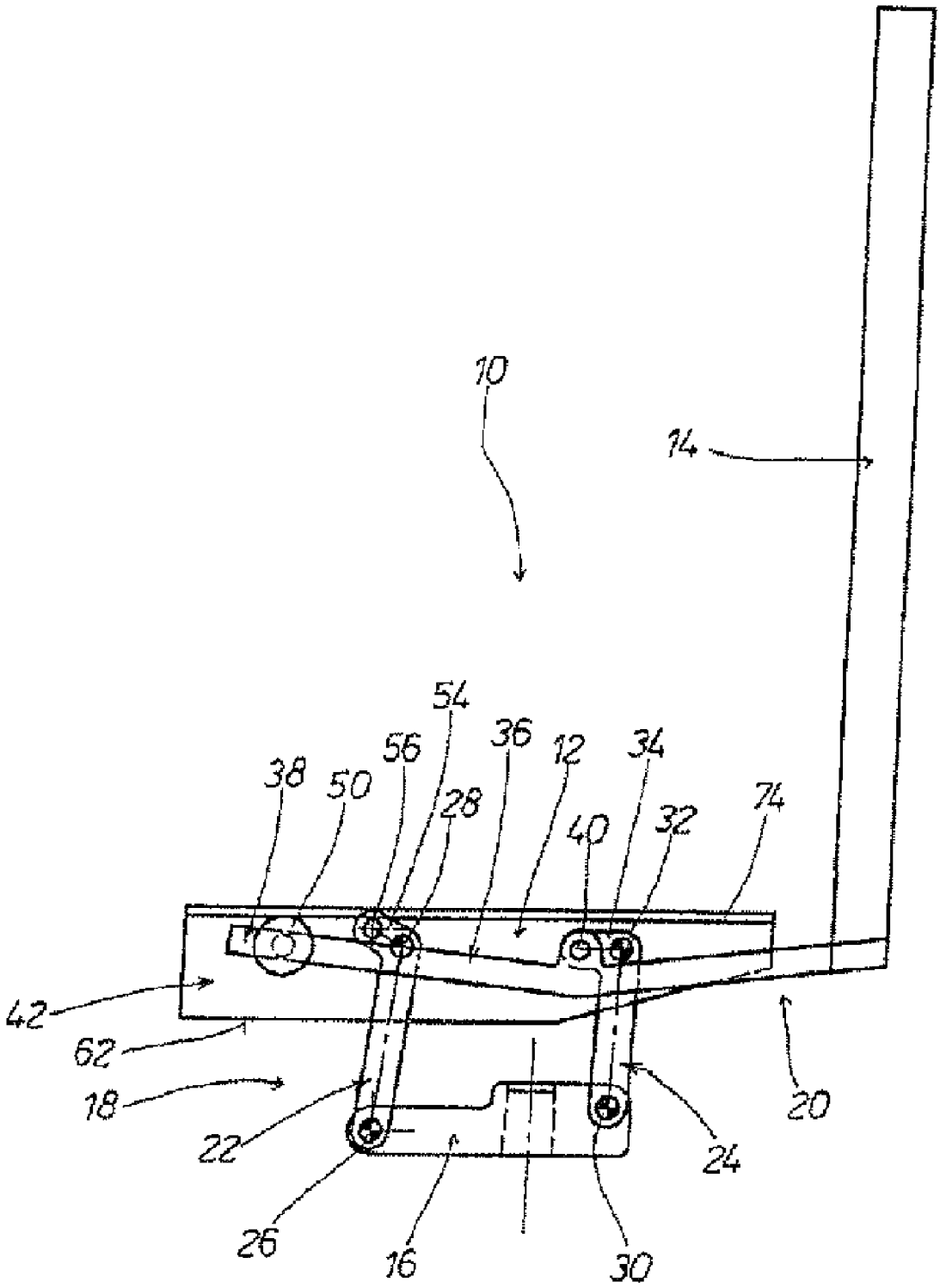
Figure 6:
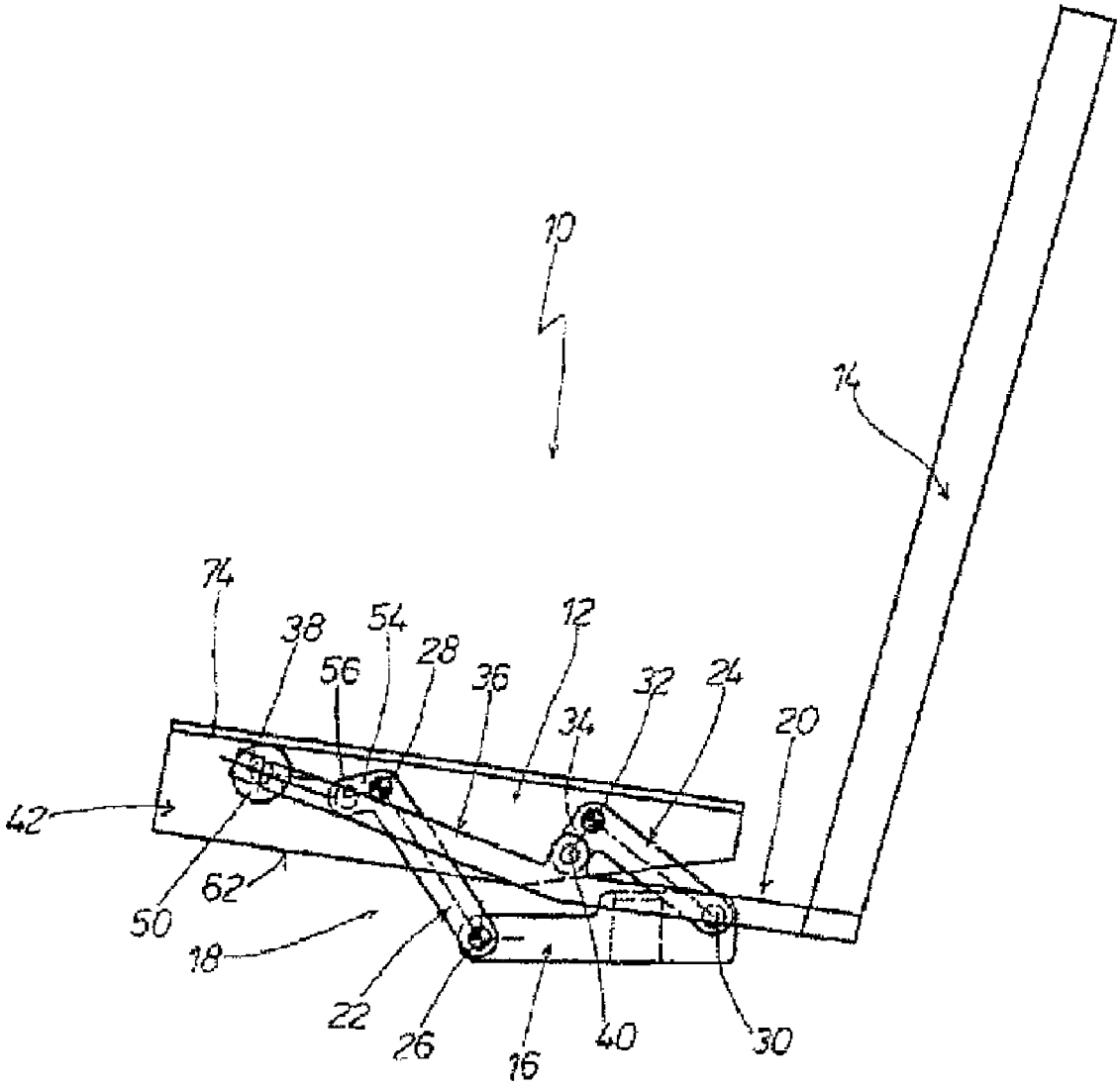
Figure 7:
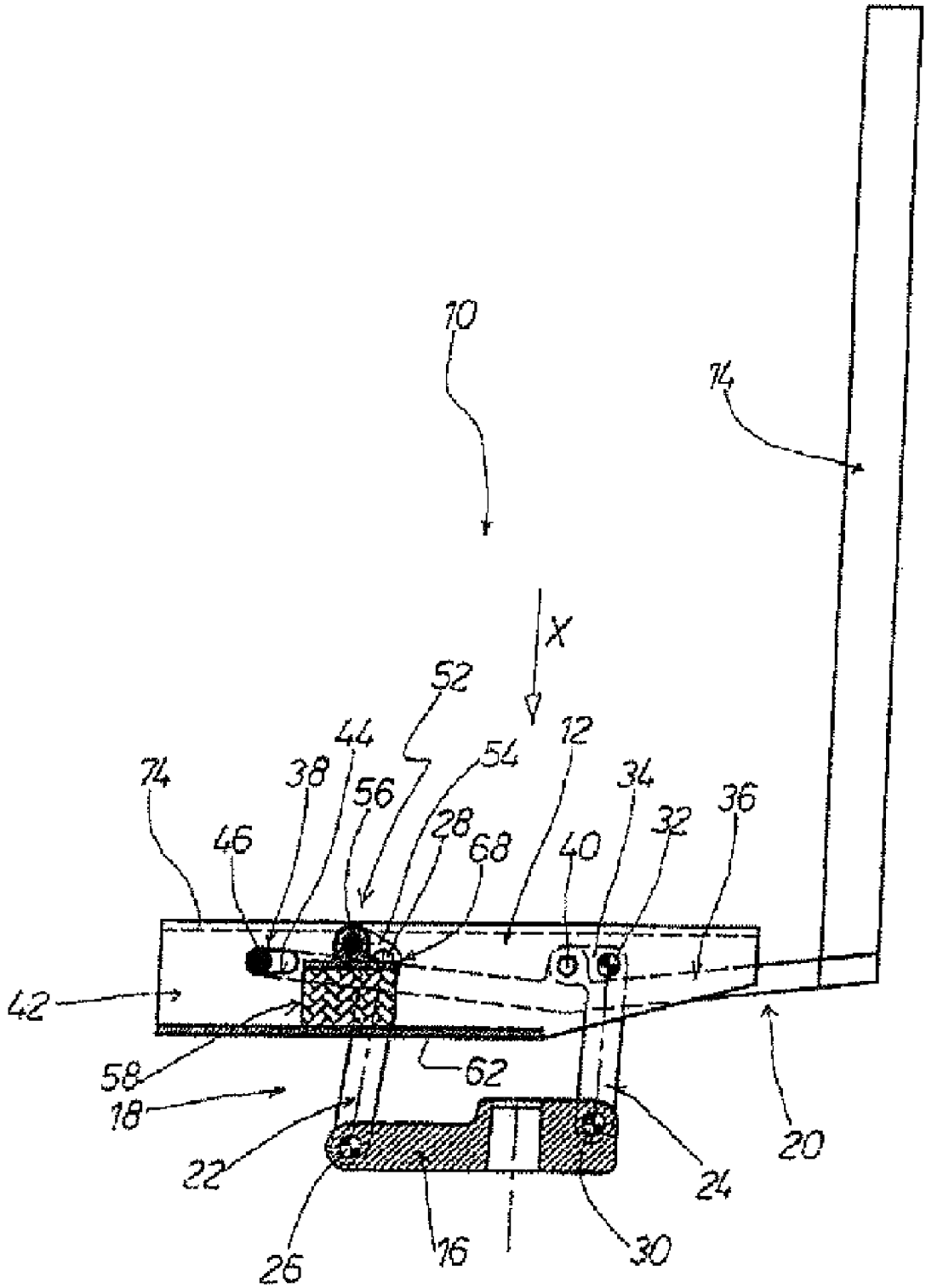
Figure 8:
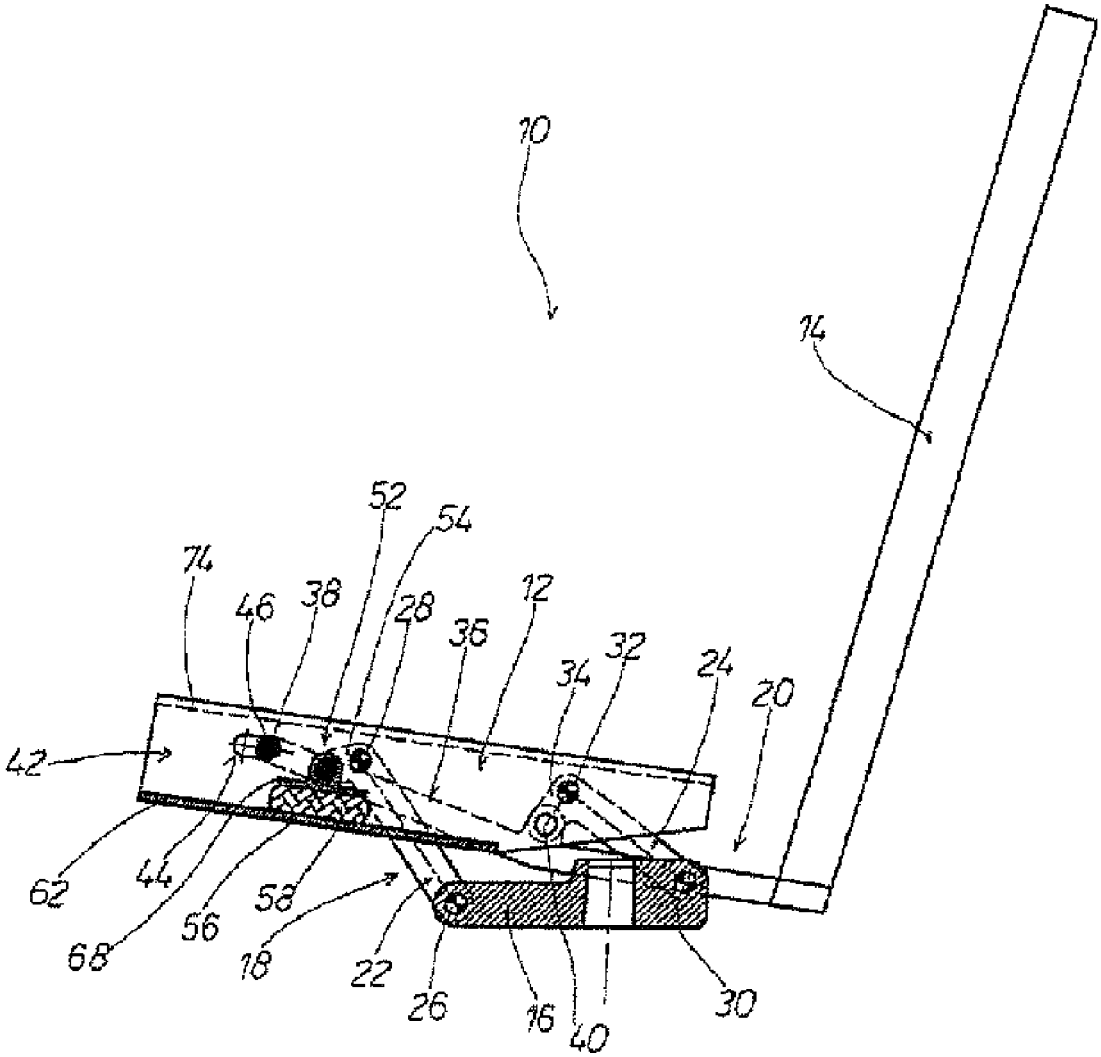
Figure 10:
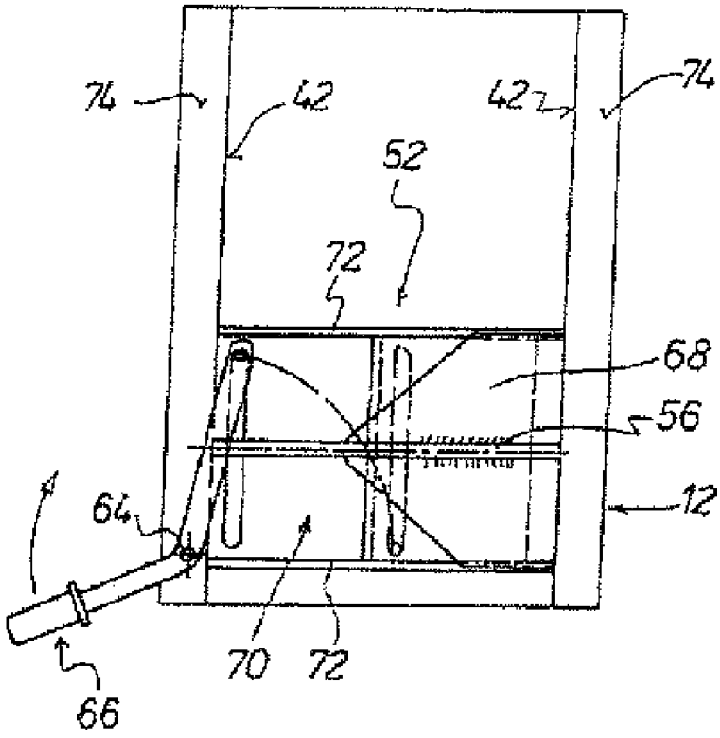
Figure 9:
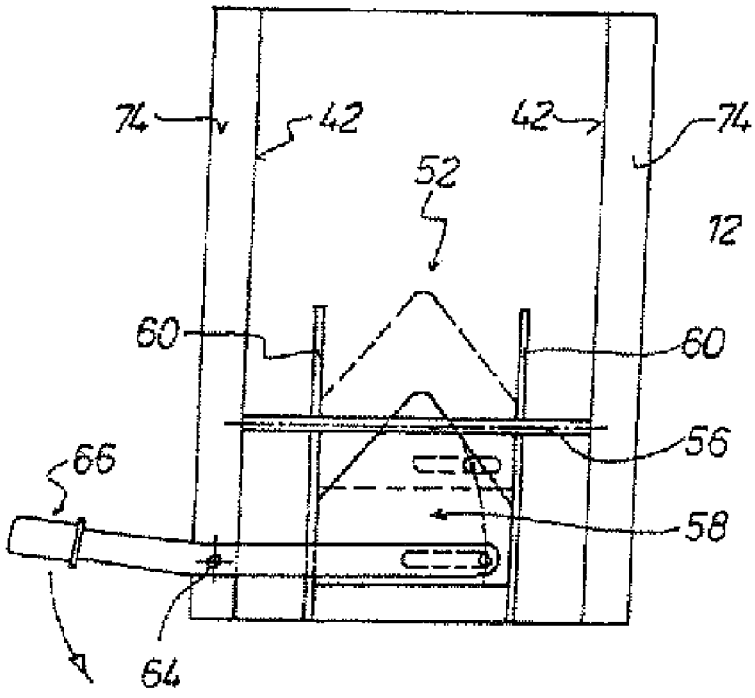

Further features, details and advantages will become apparent from the description which follows of exemplary embodiments of the seat according to the invention which are represented in the drawing, in which:

FIG. 1 shows a first design of the seat in an upright position,

FIG. 2 shows the seat according to FIG. 1 in a rearwardly inclined position, FIG. 3 shows a second embodiment of the seat in an upright seat position, FIG. 4 shows the seat according to FIG. 3 in a rearwardly inclined position, FIG. 5 shows a third embodiment of the seat in an upright position similar to FIGS. 1 and 3, FIG. 6 shows the seat according to FIG. 5 in a rearwardly inclined position, FIG. 7 shows an embodiment of a seat which is similar to the seat according to FIGS. 1 and 2 and which is designed with a weight-adjustment device, in an upright position, FIG. 8 shows the seat according to FIG. 7 in a weight-loaded, rearwardly inclined position, FIG. 9 shows a schematic representation of an embodiment of the weight-adjustment device of the seat according to FIGS. 7 and 8, and FIG. 10 shows a schematic representation of another embodiment of the weight-adjustment device of the seat according to FIGS. 7 and 8.

FIGS. 1 and 2 show a first embodiment of the seat 10 in a side view. The seat 10 comprises a seat panel 12 and a backrest 14. The seat panel 12 is connected to a base device 16 of the seat 10 by means of a first connecting device 18. The backrest 14 is connected to the seat panel 12 by means of a second connecting device 20.

The first connecting device 18 comprises a pair of front connecting levers 22 situated opposite one another on the side of the seat panel 12 and a pair of rear connecting levers 24 situated opposite one another on the side of the seat panel 12. The front connecting levers 22 are pivotally connected to the base device 16 by means of pivots 26 and to the seat panel 12 by means of pivots 28. The rear connecting levers 24 are pivotally connected to the base device 15 by means of pivots 30 and to the seat panel 12 by means of pivots 32.

The front connecting levers 22 are longer between the pivots 26 and 28 than the rear connecting levers 24 between the pivots 30 and 32.

The rear connecting levers 24 are each designed with an angled extension 34 so as to form toggle levers, with the pivot 32 being provided in the knee region of the respective rear connecting lever 24.

The second connecting device 20, which is intended for connecting the backrest 14 to the seat panel 12, comprises two rod elements 36 which are situated opposite one another on the side of the seat panel 12 and which are mounted in a pivotable manner and with a limited degree of linear mobility on the seat panel 12 by way of their front end 38. The rod elements 36 are additionally connected in a pivotable manner to the angled extension 34 of the rear connecting levers 24. For this purpose, the respective rod element 36 is connected to the associated angled extension 34 by means of a pivot 40.

In the exemplary embodiment of the seat 10 represented in FIGS. 1 and 2, the seat panel 12, which has a trough-like design with two longitudinal side walls 42, is designed to have slots 44 at the longitudinal side walls 42. Provided at the front end 38 of the respective rod element 35 is a guide element 46 which extends into the associated slot 44 and is guided therein without play.

FIGS. 3 and 4, in which identical details are designated with the same reference numbers as in FIGS. 1 and 2, represent a second embodiment of the seat 10 in the upright position and in a rearward obliquely inclined position. In this design, guide sleeves 48, which are designed as sliding shoes, are provided on the seat panel 12, which sleeves project away from the longitudinal side walls 42 of the seat panel 12 in an axially aligned pivotable manner and into which sleeves the front ends 38 of the rod elements 36 of the second connecting device 20 for the backrest 14 extend in a linearly movable manner.

FIGS. 5 and 6 illustrate a third design of the seat 10 in an upright and in a rearward obliquely inclined position, with identical details being designated with the same reference numbers as in FIGS. 1 to 4. The design according to FIGS. 5 and 5 differs from the above-described embodiments of the seat 10 in that guide members 50 are pivotally mounted on the seat panel 12 so as to project laterally away from the longitudinal side walls 42 thereof, through which guide members the front ends 38 of the rod elements 36 of the second connecting device 20 for the backrest 14 extend in a linearly movable manner. The guide members 50 may be designed, for example, as cylinders, as halls or the like with transversely oriented through holes for the rod elements 36.

FIGS. 7 and 8 illustrate a design of the seat 10 which is similar to the embodiment represented in FIGS. 1 and 2, wherein the seat 10 is designed with a weight-adjustment device 52. A corresponding design of the weight-adjustment device is schematically illustrated in FIG. 10, which is a view in the direction of sight of the arrow X in FIG. 7. In this design of the seat 10, the front connecting levers 22 are each designed with an angled extension 54 so as to form toggle levers, with the respective pivot 28 being provided in the knee region of the corresponding toggle lever. The two angled extensions 54 are connected to one another by means of a connecting rod 56 which forms a component of the weight-adjustment device 52.

FIG. 9 schematically illustrates a design of the weight-adjustment device 52 which comprises an elastically compliant wedge element 58 which interacts with the connecting rod 56. The wedge element 58 is guided in a linearly movable manner along two guide elements 60. The guide elements 60 project upwardly from the bottom 62 of the trough-like seat panel 12.

An adjustment handle 55 which can be pivoted about a pivot 64 is connected to the wedge element 58 in order to bring the wedge element 58 more or less into operative connection with the connecting rod 56 along the guide elements 60.

Thin dashed lines depict the wedge element 58 in an end position in which the compressibility of the wedge element 58 is comparatively small so as to achieve a corresponding seat hardness.

y contrast with FIG. 9, FIG. 10 illustrates a design of the weight-adjustment device 52 which comprises a dimensionally stable wedge element 58, which is fattened to the connecting rod 56, and a cuboidal body 70 made of elastically compliant material which is guided in a linearly movable manner along guide elements 72 which project upwardly from the bottom 62 of the trough-like seat panel 12. To adjust the elastic body 70 along the guide elements 72, use is made of an adjustment handle 66 which can be pivoted about a pivot 64. The pivot 64 is provided on one of the two lateral longitudinal edges 74 which face in opposite directions from one another. The longitudinal edges 74 project away from the longitudinal side walls of the trough-like seat panel 12 in one niece therewith.

Referring to FIG. 1, the base device 16 may be provided on a chair column element 100. The column element 100 may be adjustable in its length in order to achieve a height-adjustable chair. This chair is expediently an office chair. The chair column element 100 may comprise a damping device which is, for example, a gas spring as used in office chairs.

Identical details are respectively designated by the same reference numbers in FIGS. 1 to 10, which means that there is no need to give a detailed description of all the details in each case in conjunction with the figures.

The invention claimed is:

1. A seat having a seat panel and a backrest, wherein the seat panel is connected to a base device by means of a first connecting device and can be adjusted with respect to the base device in height and at the same time in inclination and in a seat longitudinal direction, and wherein the backrest is connected to the seat panel by means of a second connecting device and can be simultaneously adjusted with the seat panel in inclination and in height, characterized in that the first connecting device comprises, laterally opposite one another, a pair of front connecting levers and a pair of rear connecting levers, wherein the front connecting levers are longer than the rear connecting levers and wherein each of the front connecting levers and the rear connecting levers is articulated with one end thereof at the base device and another end thereof at the seat panel, in that the rear connecting levers each comprises an elongated main portion and an angled extension so forming a toggle lever, the angled extension extending in a direction facing away from the backrest from the elongate main portion, and in that the second connecting device comprises, laterally opposite one another, a pair of rod elements which are mounted in a pivotable and linearly movable manner on the seat panel by way of their front ends and which are connected in a pivotable manner to the angled extension of the rear connecting levers.

2. The seat as claimed in claim 1, characterized in that the seat panel is designed with associated slots, and in that a guide element which is guided in the associated slots is provided at the front end of the respective rod element.

3. The seat as claimed in claim 1, characterized in that guide sleeves into which the front end of the respective rod element (extends in a linearly movable manner are provided in a pivotable manner on the seat panel.

4. The seat as claimed in claim 1, characterized in that guide members through which the front end of the rod elements extends in a linearly movable manner are provided in a pivotable manner on the seat panel.

5. The seat as claimed in claim 1, characterized in that the front connecting levers are each designed with an angled extension, said extensions being connected to one another by means of a connecting rod which is provided for a weight-adjustment device.

6. The seat as claimed in claim 5, characterized in that the weight-adjustment device comprises an elastically compliant wedge element which can be adjusted with respect to the connecting rod.

7. The seat as claimed in claim 5, characterized in that the weight-adjustment device comprises a dimensionally stable wedge element, which is fastened to the connecting rod, and a body made of an elastically compliant material which can be adjusted with respect to the wedge element.

8. The seat as claimed in claim 1, characterized in that the seat panel has a trough-like design with two longitudinal side walls and longitudinal edges projecting laterally away therefrom on the upper side in opposite directions from one another.

9. The seat as claimed in claim 8, characterized in that the longitudinal side walls are designed with cutouts for receiving ends of a guide element.

10. The seat as claimed in claim 1, characterized in that the base device is configured for mounting on a chair column element.

11. The seat as claimed in claim 10, characterized in that the chair column element can be adjusted in its length.

12. The seat as claimed in claim 10, characterized in that the chair column element comprises a damping device.

* * * * *

UNITED STATES PATENT AND TRADEMARK OFFICE

CERTIFICATE OF CORRECTION

PATENT NO. : 8,215,710 B2
APPLICATION NO. : 12/517401
DATED : July 10, 2012
INVENTOR(S) : Christian Erker It is certified that error appears in the above-identified patent and that said Letters Patent is hereby corrected as shown below:

In the Specification

Column 2, line 16, “Wedge” should read -- wedge --.
Column 4, line 21, “y contrast” should read -- By contrast --.
Column 4, line 34, “niece” should read -- piece --.

Signed and Sealed this
Tenth Day of February, 2015

Michelle K. Lee

Michelle K. Lee
*Deputy Director of the United States Patent and Trademark Office*